US007003853B2

(12) United States Patent
Bernhardt et al.

(10) Patent No.: US 7,003,853 B2
(45) Date of Patent: Feb. 28, 2006

(54) INTERMEDIATE CARD FOR MANUFACTURING NONWOVENS OF FIBROUS MATERIAL AS WELL AS METHOD FOR MANUFACTURING NONWOVENS OF FIBROUS MATERIAL

(75) Inventors: Siegfried Bernhardt, Bremen (DE); Robert Kamprath, Brake (DE); Heinz-Werner Naumann-Burghardt, Berne (DE)

(73) Assignee: Spinnbau GmbH, (DE)

( * ) Notice: Subject to any disclaimer, the term of this patent is extended or adjusted under 35 U.S.C. 154(b) by 0 days.

(21) Appl. No.: 10/899,043

(22) Filed: Jul. 27, 2004

(65) Prior Publication Data

US 2005/0022343 A1 Feb. 3, 2005

(30) Foreign Application Priority Data

Jul. 29, 2003 (EP) ..... 03017145

(51) Int. Cl.
*D01G 25/00* (2006.01)

(52) U.S. Cl. ..... 19/296; 19/308

(58) Field of Classification Search ..... 19/98, 19/99, 105, 106 R, 112, 65 R, 161.1, 296, 19/298, 300, 301, 302, 304, 308
See application file for complete search history.

(56) References Cited

U.S. PATENT DOCUMENTS

| | | | | |
|---|---|---|---|---|
| 4,523,350 | A * | 6/1985 | Schmiedgen et al. | 19/98 |
| 4,852,217 | A * | 8/1989 | Bernhardt et al. | 19/98 |
| 5,226,214 | A * | 7/1993 | Napolitano | 19/296 |
| 5,584,101 | A * | 12/1996 | Brabant et al. | 19/304 |
| 6,050,469 | A * | 4/2000 | Brabant et al. | 226/183 |
| 6,073,313 | A * | 6/2000 | Lasenga et al. | 19/99 |
| 6,732,412 | B1 * | 5/2004 | Collotte et al. | 19/308 |

FOREIGN PATENT DOCUMENTS

| | | |
|---|---|---|
| EP | 0 484 812 A1 | 5/1992 |
| EP | 0 817 875 B1 | 10/1996 |

* cited by examiner

*Primary Examiner*—Gary L. Welch
(74) *Attorney, Agent, or Firm*—Diller, Ramik & Wight

(57) ABSTRACT

In an intermediate card for manufacturing nonwovens of fibrous material, with a drawing-in means (2), with at least one main cylinder (4), and with several fiber take-off means (6*a*, 6*b*, 6*c*) for taking over at least two card webs from the main cylinder (4), the at least two card webs being adapted to be deposited as a nonwoven onto a common conveying belt of a conveying means, it is provided that each fiber take-off means (6*a*, 6*b*, 6*c*) transfers the taken-off card webs onto transfer sections (15*a*, 15*b*, 15*c*, 15*d*) circumferentially offset with respect to each other and forming part of a permeable conveying surface (15) curved in a circularly cylindrical manner, the circumferential speed of which is adapted to the transfer speed of the card webs at the transfer sections (15*a*, 15*b*, 15*c*, 15*d*) as to direction and amount, the transfer sections of the conveying surface (15) being sucked.

26 Claims, 7 Drawing Sheets

INTERMEDIATE CARD FOR MANUFACTURING NONWOVENS OF FIBROUS MATERIAL AS WELL AS METHOD FOR MANUFACTURING NONWOVENS OF FIBROUS MATERIAL

BACKGROUND OF THE INVENTION

1. Field of the Invention

The invention relates to an intermediate card for manufacturing nonwovens of fibrous material, as well as to a method for manufacturing nonwovens of fibrous material.

2. Description of Related Art

Such an intermediate card is known, for example, from European Patent 484 812 A. In this intermediate card, each of two fiber take-off means takes a card web from a main cylinder and deposits it on a respective conveyor belt by means of stuffer and take-off rollers. In the course of this, the conveyor belt of a fiber take-off means transfers a card web onto a conveyor belt of another fiber take-off means so that eventually, all card webs are able to be carried away as a nonwoven on a common conveyor belt.

With several intermediate cards arranged behind each other, it is known from European Patent 817 875 A to deposit the card web of the intermediate card mechanically on a common conveyor belt which is sucked throughout in the region of the card web. Such an installation facilitates the realization of high-speed carding installations permitting production speeds of more than 150 m/min, preferably of more than 200 m/min up into the range of from 400 to 500 m/min.

In the last-mentioned state of the art, the take-off of two card webs from the main cylinder is provided, the card webs being doubled on a common succeeding roller.

It is also known to transfer two card webs taken off from a main cylinder onto a common conveyor belt after each other, said conveyor belt being sucked at the transfer site.

SUMMARY OF THE INVENTION

It is the object of the present invention to improve the transfer of repeatedly taken-off card webs onto a common conveyor belt and to permit a more compact structure of an intermediate card.

The invention advantageously provides that each fiber take-off means transfers the taken-off card webs onto transfer sections of a permeable conveying surface curved in a circularly cylindrical manner, said transfer sections being mutually offset in circumferential direction. The circumferential speed of the conveying surface is adapted to the transfer speed of the card webs from the fiber take-off means as to direction and amount, the conveying surface being sucked at the transfer sections.

The invention provides a take-off system in which a guided transfer of individual card webs onto a common parallel conveyor belt is permitted. The permeable conveying surface curved in a circularly cylindrical manner permits a more favorable deposition angle at the transfer sections. The curved surfaces at the transfer sections make it easier to take out the fibers at the take-off roller of the fiber take-off means in connection with the sucking of the conveying surface in the region of the transfer sections. The superposition of the card webs in rapidly succeeding transfer sections also permits a better connection between the upper web and the bottom web as well as a compact construction of the intermediate card. The conveying surface curved in a circularly cylindrical manner permits a transfer of the card webs to the conveyor belt which is poor in distortion, so that higher production speeds are possible.

In one embodiment, it is provided that the permeable conveying surface is formed by a rotating screening drum. The screening drum takes over several card webs at different transfer sections, which are transferred in common onto a permeable conveyor belt of a conveying means at a transfer site where the suction flow into the screening drum is at least interrupted or reversed.

The conveyor belt is adapted to be sucked at the transfer site between the screening drum and the conveyor belt from the side of the conveyor belt opposite the transfer site.

According to another preferred embodiment, it is provided that a permeable endlessly circulating conveyor belt of a conveying means loops a rotating screening drum at least in the region of the transfer sections of the conveying surface and carries away the card webs lying on top of each other and sucked by the screening drum onto the conveyor belt. The speed of the conveyor belt corresponds to the circumferential speed of the rotating screening drum. This embodiment also follows the principle that a curved surface of a last roller of the fiber take-off means transfers the card web onto the permeable conveying surface curved in a circularly cylindrical manner.

Preferably, it is provided that the conveying means is adapted to be pivoted about an axis coaxial to the axis of the screening drum in such a manner that the transfer site of the conveyor belt for the common card web from the conveying means to a succeeding means is height-adjustable.

The fiber take-off means may comprise at least one doffer roller being in engagement with the main cylinder. In another embodiment, it is provided that the fiber take-off means comprises at least one tangling roller being in engagement with the main cylinder, transferring the card web onto at least one doffer roller. One or more fiber take-off means may comprise one tangling roller, respectively, each of which takes over one card web from the main cylinder. From the respective tangling roller of a fiber take-off means, the card web can be transferred to one or more doffer rollers.

Preferably, each doffer roller is in engagement with at least one succeeding stuffing roller and a take-off roller or only a take-off roller.

In a preferred embodiment, it is provided that the drawing-in means with drawing-in rollers and a licker-in comprises at least one tangling roller between the licker-in and the main cylinder, which rotates in the same direction as the main cylinder and the licker-in.

It may also be provided that the fibers are transferred from the licker-in to the main cylinder on at least two paths.

Hereinafter, several embodiments of the invention are explained in detail with reference to the drawings.

DETAILED DESCRIPTION OF THE PREFERRED EMBODIMENTS

Figure 1:
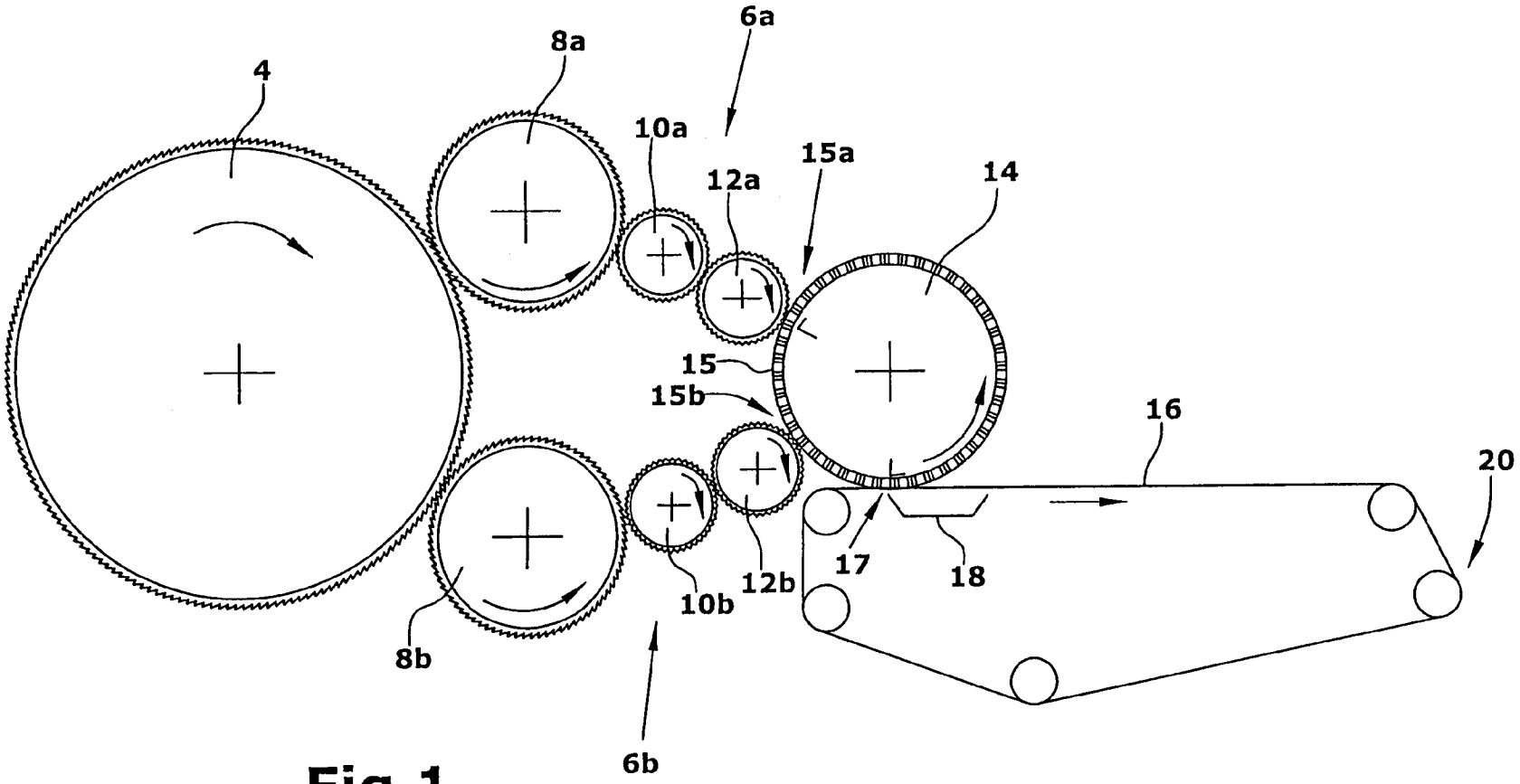
FIG. 1 shows a first embodiment of an intermediate card with a screening drum.

The portion of an intermediate card on the card web take-off side shown in FIG. 1 comprises a drawing-in means 2 by means of which fibers are transferred onto a main cylinder 4. A possible embodiment of a drawing-in means 2 with tangling rollers 3*a*, 3*b* is apparent from FIG. 5. Each of two fiber take-off means 6*a*, 6*b* on the card web take-off side of the intermediate card takes one card web off the main cylinder 4 and transfers it onto a screening drum 14 forming a permeable conveying surface 15 curved in a circularly cylindrical manner and being adapted to be partially sucked in the interior so that an airflow from outside to inside flows through the jacket surface of the screening drum 14 in a predetermined segment.

Each fiber take-off means 6*a*, 6*b* is comprised of a doffer roller 8*a*, 8*b* and at least one take-off roller 12*a*, 12*b*, at least one stuffing roller 10*a*, 10*b* being able to be arranged between the doffer roller 8*a*, 8*b* and the take-off roller 12*a*, 12*b*.

The screening drum 14 forms a permeable conveying surface 15 curved in a circularly cylindrical manner onto which the card webs transferred by the fiber take-off means 6*a*, 6*b* can be transferred at transfer sections 15*a*, 15*b* circumferentially offset with respect to each other. The transfer sections 15*a*, 15*b* are located at the narrowest sites between the take-off rollers 12*a*, 12*b* and the conveying surface 15. As to direction and amount, the circumferential speed of the screening drum at its conveying surface is adapted to the transfer speed of the card webs at the transfer sections 15*a*, 15*b*. Preferably, the screening drum 14 is sucked in a segment extending from the take-off roller 12*a* to a transfer site between the screening drum 14 and a conveyor belt 16. The delimitation of the sucked region is indicated by angle symbols.

The advantage of the segmented sucking of the screening drum 14 also consists in that only a small air volume is necessary to be able to securely transfer the card webs at the transfer sites even at high transport speeds when the fiber take-off means 6*a*, 6*b* are laterally sealed. On the underside, the permeable conveyor belt 16 may comprise a suction box 18 at the transfer site 17 between the screening drum 14 and the conveyor belt 16, which suction box sucks the conveyor belt at the transfer site and in a predetermined region behind the transfer site. Alternatively, the underside of the conveyor belt may be provided with air guide blades 22 between the transfer site between the screening drum and the conveyor belt up to a site of transfer 20 to a succeeding machine, said guide blades providing for a secure adhesion of the card webs on the conveyor belt 16 as a consequence of the deflection of an airflow below the conveyor belt.

Figure 2:
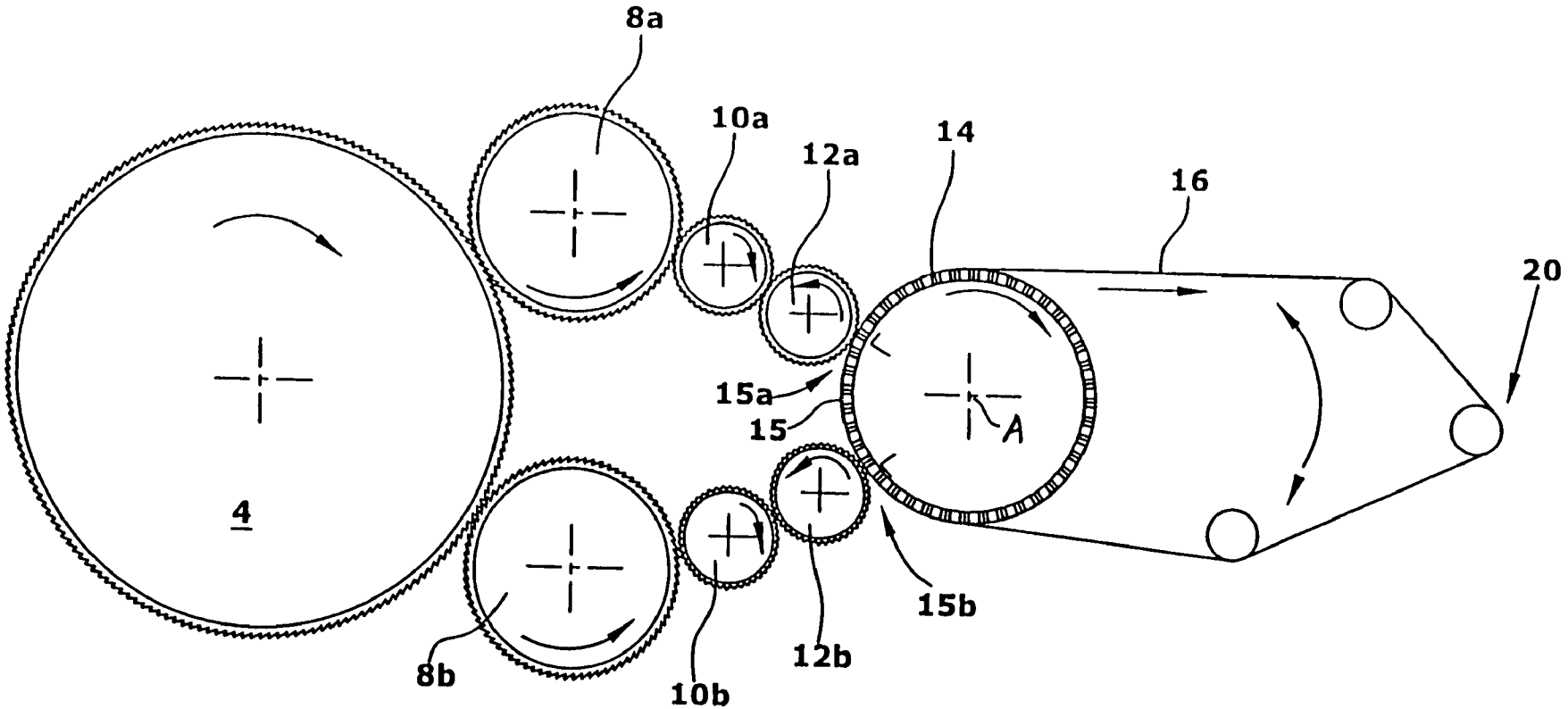
FIG. 2 shows a second embodiment where the screening drum is surrounded by a permeable conveyor belt.

FIG. 2 shows an embodiment where the conveyor belt 16 loops the screening drum 14 and is moved at the same speed as the circumferential speed of the screening drum 14. The preferred solution avoids any further transfer site between a screening drum 14 and the conveyor belt 16 and thus permits an even more compact construction of the intermediate card.

Figure 3:
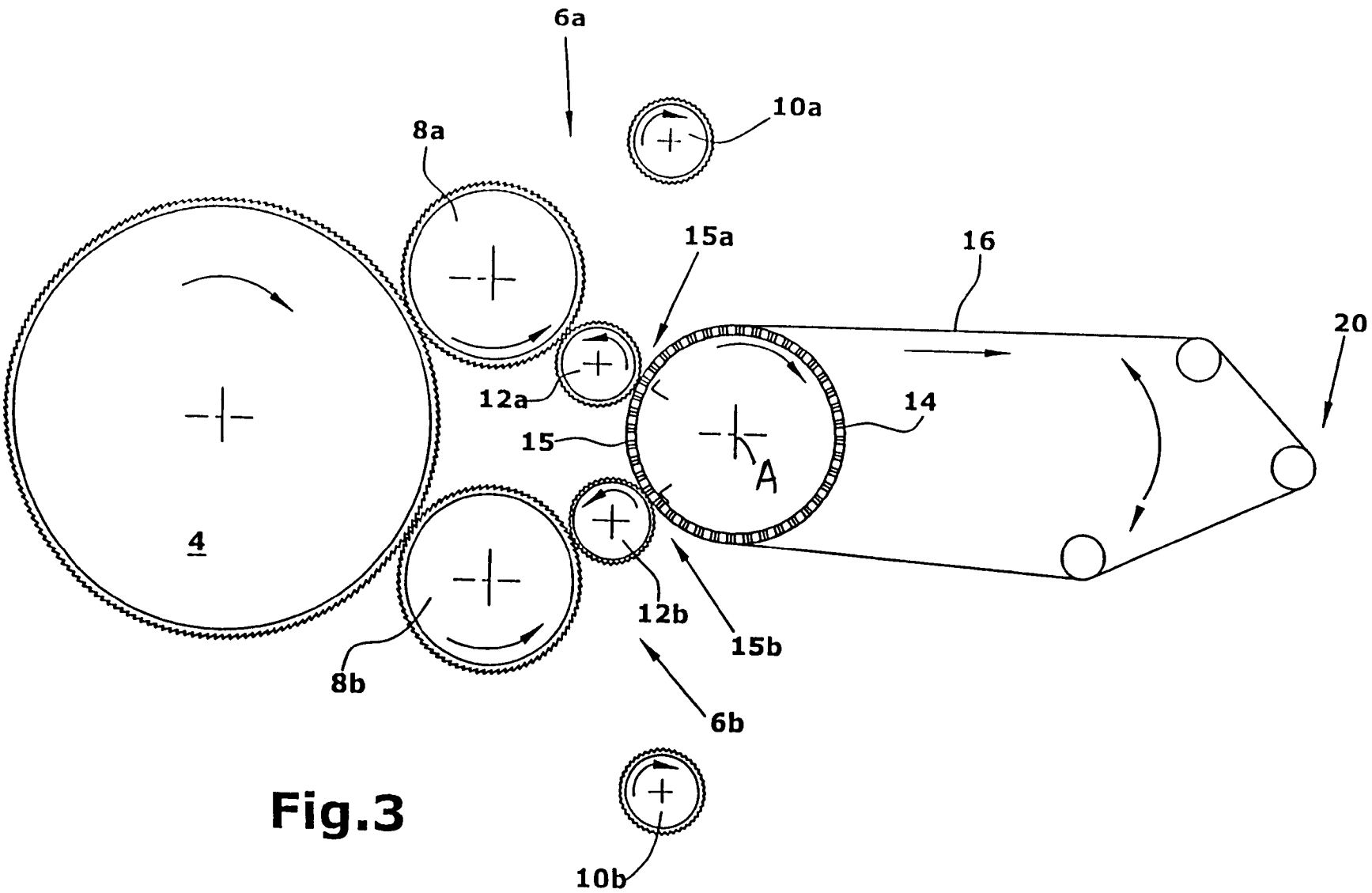
FIG. 3 shows an embodiment without stuffing rollers.

FIG. 3 shows an embodiment where pivotable stuffing rollers 10*a*, 10*b* are shown in a position of being pivoted away in which they are no longer in engagement with the doffer rollers 8*a*, 8*b* and the take-off rollers 12*a*, 12*b*.

By a suitable pivoting means, the stuffing rollers 10*a*, 10*b* can be brought out of or into engagement.

Figure 4:
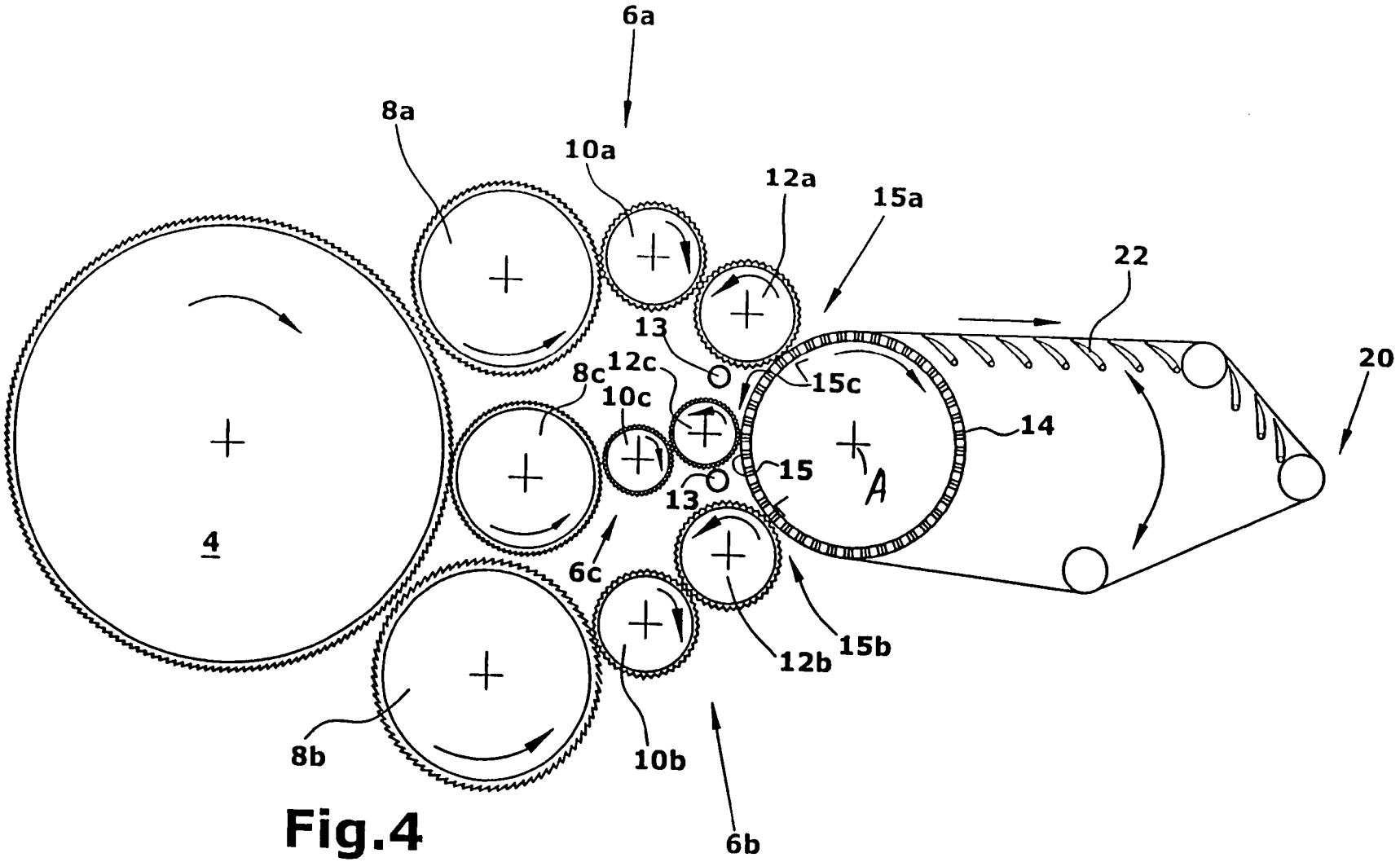
FIG. 4 shows an embodiment where three card webs are adapted to be transferred onto the conveyor belt.

Finally, FIG. 4 shows an embodiment where altogether three fiber take-off means 6*a*, 6*b*, 6*c* are provided so that a total of three card webs on the endlessly circulating conveyor belt 16 in connection with the permeable conveying surface 15 formed together with the screening drum 14 can be disposed at transfer sites 15*a*, 15*b*, 15*c*.

This permits the production of a high-performance intermediate card with a high mass per unit area of the resulting card web at a high production speed and with a short and compact construction.

In the embodiments of FIGS. 2 to 7, the screening drum 14 may also be sucked completely instead of in segments. It goes without saying that the conveyor belt 16 may also comprise air guide blades 22 at the underside between the point of separation from the screening drum 14 to the site of transfer 20 to the succeeding machine in the embodiments of FIGS. 2 to 7.

In all embodiments, it may be provided that the conveying means with the conveyor belt 16 is adapted to be pivoted about the rotational axis A of the screening drum 14 so that the height of the site of transfer 20 to a succeeding machine is adjustable.

Between the take-off rollers 12*a*, 12*b*, 12*c*, 12*d* of all embodiments, air guiding means 13 such as tubes as shown in FIG. 4 can be arranged to reduce cross-flows.

Figure 5:
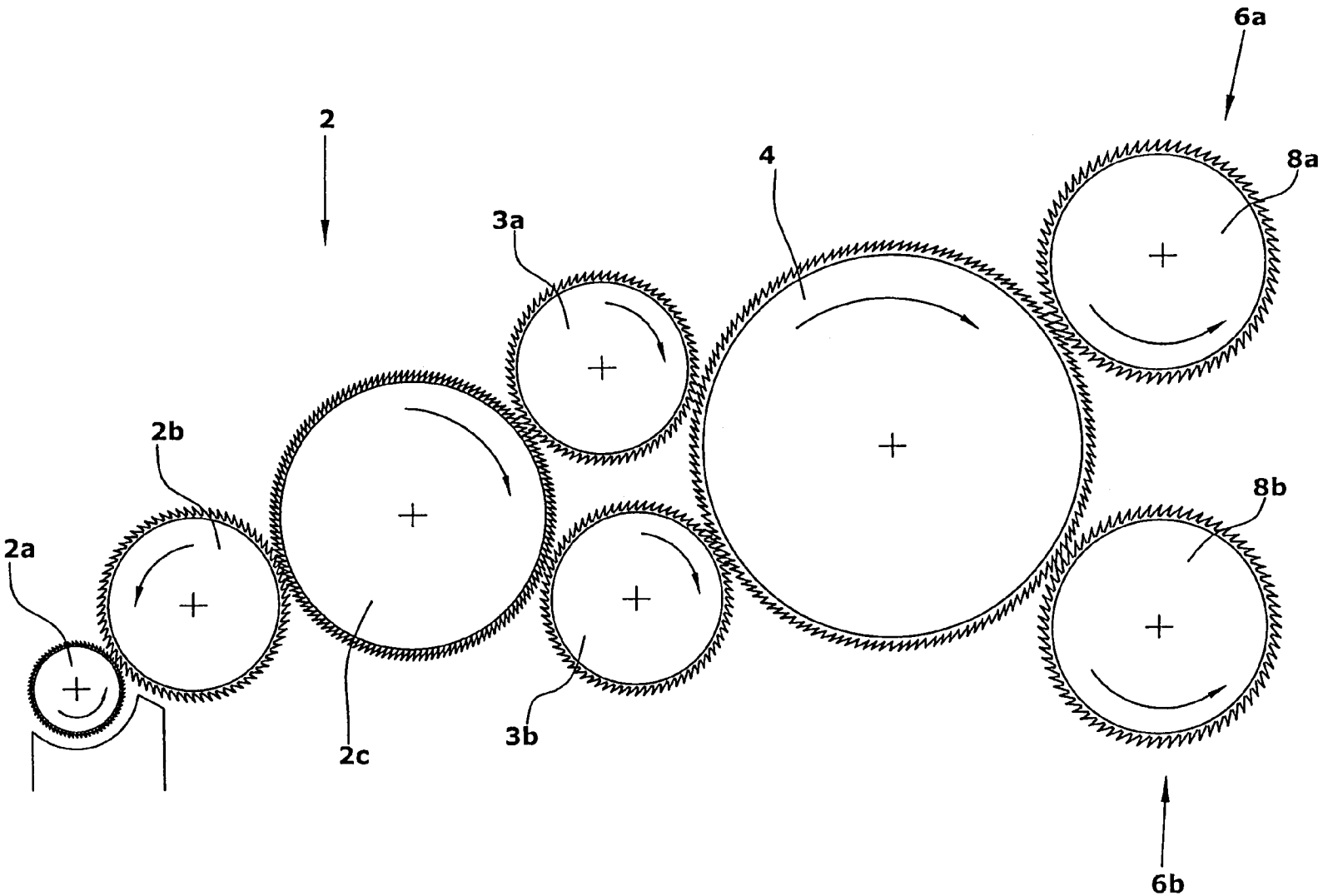
FIG. 5 shows a drawing-in means of the intermediate card.

FIG. 5 shows an embodiment of a drawing-in means 2 with a drawing-in roller 2*a*, a taker-in 2*b* and a licker-in 2*c*. Two tangling rollers 3*a*, 3*b* are arranged between the licker-in 2*c* and the main cylinder 4. The tangling rollers 3*a*, 3*b* permit a return at the licker-in so that the carding performance of the licker-in 2*c* can be used repeatedly. It goes without saying that a single tangling roller 3 only may be in engagement with the licker-in 2*c* and the main cylinder 4. The tangling rollers 3*a*, 3*b* rotate in the same direction as the main cylinder 4 and the licker-in 2*c*.

Figure 6:
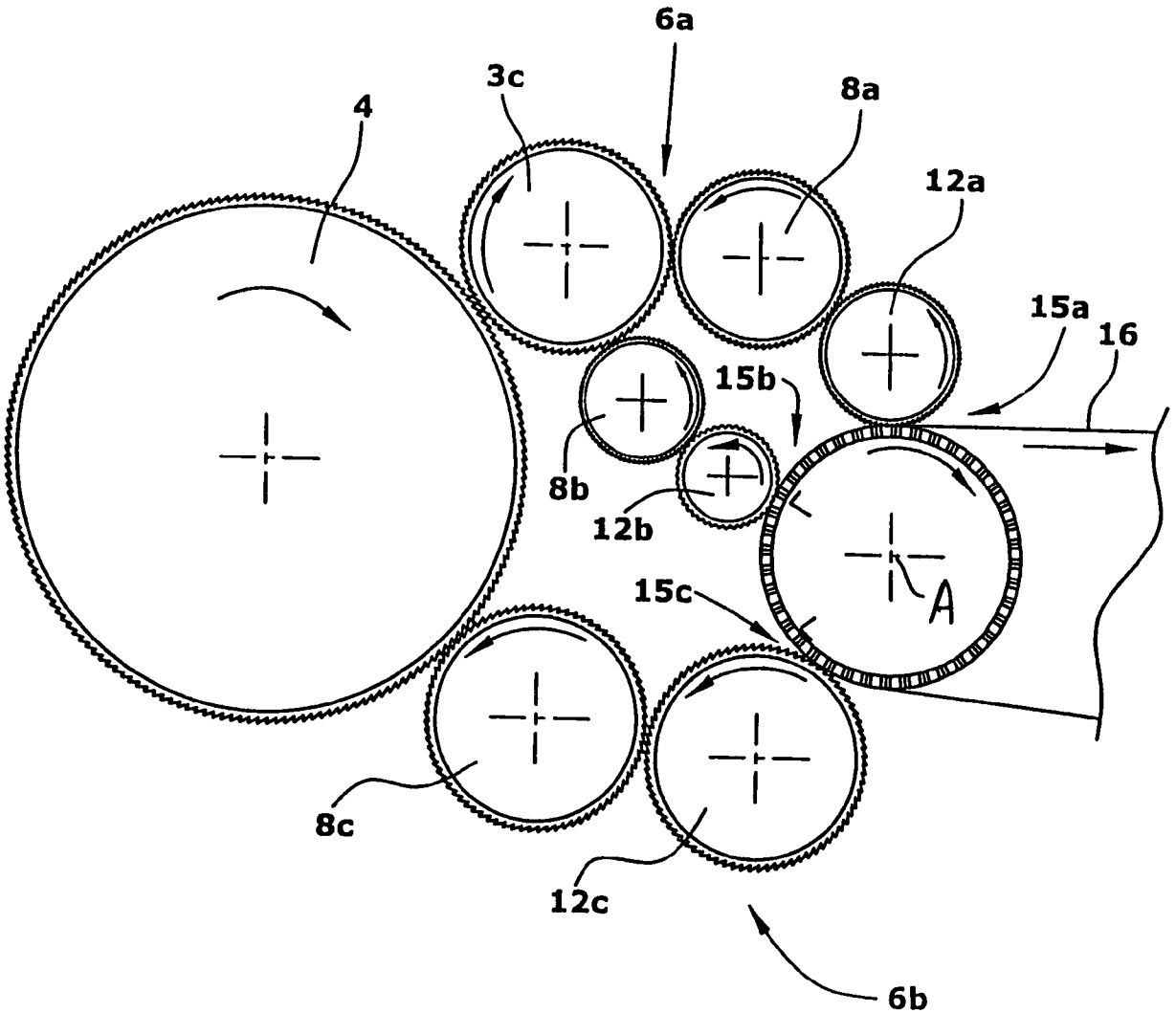
FIG. 6 shows an embodiment of a tangling roller on the web take-off side of the main cylinder.

FIG. 6 shows an embodiment where the upper fiber take-off means 6*a* comprises a tangling roller 3*c* being in engagement with the main cylinder 4 as only roller of the fiber take-off means 6*a*.

The tangling roller 3*c* rotates in the same direction as the main cylinder 4 and in opposite direction to the rotational direction of two doffer rollers 8*a*, 8*b* being in engagement with the tangling roller 3*c*. Thus, the card web transferred from the main cylinder 4 to the tangling roller 3*c* is shared out between two doffer rollers 8*a*, 8*b* and transferred from there via take-off rollers 12*a*, 12*b* or stuffing rollers in combination with take-off rollers 12*a*, 12*b* onto the conveying surface 15 of the screening drum 14 and the conveying belt 16, respectively.

In the embodiment of FIG. 6, the lower fiber take-off means 6*b* is comprised of a doffer roller 8*c* being in engagement with the main cylinder 4 and a take-off roller 12*c* being in engagement with the doffer roller 8*c*, on the one hand, and transferring the card web onto the conveying belt 16 at the screening drum 14, on the other hand.

It goes without saying that the lower fiber take-off means may also be configured as illustrated in the other embodiments.

Figure 7:
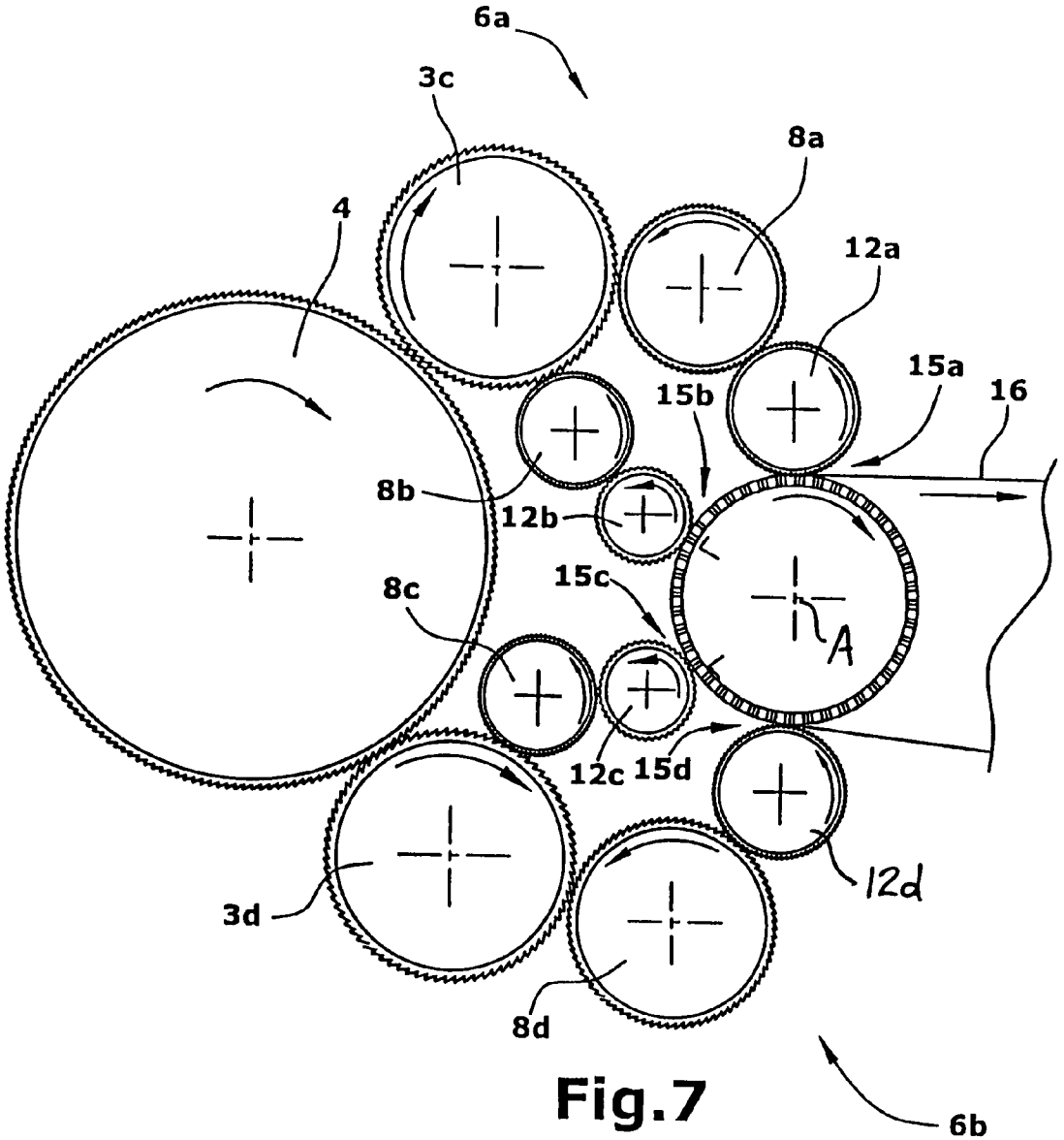
FIG. 7 shows an embodiment with two tangling rollers.

FIG. 7 shows a further embodiment where the lower fiber take-off means 6*b* is configured as an about mirrored representation of the upper fiber take-off means 6*a*. Consequently, the lower fiber take-off means comprises a tangling roller 3*d* being in engagement with the main cylinder 4, sharing out the card web between two doffer rollers 8*c* and 8*d*. It goes without saying that stuffing rollers may be arranged between the take-off rollers 8*a* to 8*d* and the take-off rollers 12*a* to 12*d* in this embodiment as well.

The diameter of the main cylinder amounts to approximately 1.200 to 1.800 mm, preferably 1.500 mm, the diameter of the tangling rollers being between 400 and 700 mm, preferably 550 mm.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. An intermediate card for manufacturing nonwovens of fibrous material comprising a drawing-in means (2), at least one main cylinder (4), several fiber take-off means **(6*a*, 6*b*) for taking over at least two card webs from the main cylinder (4), each fiber take-off means (6*a*, 6*b*) transfers the card webs taken off from the fiber take-off means onto vacuum transfer sections (15*a*, 15*b*, 15*c*, 15*d*) circumferentially offset with respect to each other and being part of a permeable conveying surface (15) curved in a circular cylindrical manner and having a circumferential speed adapted to the transfer speed of the card webs at the transfer sections (15*a*, 15*b*, 15*c*, 15*d*), and only one conveyor belt (16) onto which the card webs are directly transferred by the transfer sections (15*a*, 15*b*, 15*c*, 15*d*)**.

2. The intermediate card according to claim 1, characterized in that the permeable conveying surface (15) is formed on a rotating screening drum (14).

3. The intermediate card according to claim 2, characterized in that the conveyor belt is permeable and the conveying surface (15) of the screening drum (14) transfers the taken-over card webs onto the permeable conveyor belt (16) at a transfer site (17) at which evacuation of the screening drum (14) is one of interrupted and reversed to blowing air from the screening drum (14).

4. The intermediate card according to claim 3, characterized in that a run of the conveyor belt (16) is subject to a vacuum at the transfer site (17) located between the screening drum (14) and the conveyor belt (16).

5. The intermediate card according to claim 1, characterized in that the conveyor belt (16) is a permeable endlessly circulating conveyor belt (16) which loops about a rotating screening drum (14) defining the transfer sections **(15*a*, 15*b*, 15*c*, 15*d*) of the conveying surface (15), and the permeable conveying surface (15) is formed in common by the conveyor belt (16) and the screening drum (14) supporting the conveyor belt (16)**.

6. The intermediate card according to claim 1, characterized in that the conveyor belt (16) is pivoted about an axis coaxial to an axis of the screening drum (14) such that a site of transfer (20) of the nonwoven from the conveyor belt (16) is height-adjustble.

7. The intermediate card according to claim 1, characterized in that the fiber take-off means **(6*a*, 6*b*, 6*c*) include at least one doffer roller (8*a*, 8*b*, 8*c*) in engagement with the main cylinder (4)**.

8. The intermediate card according to claim 7, characterized in that each doffer roller **(8*a*, 8*b*, 8*c*, 8*d*) is in engagement with at least one of one succeeding stuffing roller (10*a*, 10*b*, 10*c*) and a take-off roller (12*a*, 12*b*, 12*c*, 12*d*)**.

9. The intermediate card according to claim 1, characterized in that the fiber take-off means **(6*a*, 6*b*, 6*c*) include at least one tangling roller (3*c*, 3*d*) in engagement with the main cylinder (4), which transfers the card web onto at least one doffer roller (8*a*, 8*b*; 8*c*, 8*d*)**.

10. The intermediate card according to claim 1, characterized in that the drawing-in means (2) includes at least one tangling roller **(3*a*, 3*b*) rotating in the same direction as the main cylinder (4)**.

11. The intermediate card as defined in claim 1 wherein there is only a single permeable conveying surface (15) located between the take-off means **(6*a*, 6*b*) and the conveyor belt (16)**.

12. The intermediate card according to claim 11, characterized in that the permeable conveying surface (15) is formed on a rotating screening drum (14).

13. The intermediate card according to claim 12, characterized in that the conveyor belt is permeable and the conveying surface (15) of the screening drum (14) transfers the taken-over card webs onto the permeable conveyor belt (16) at a transfer site (17) at which evacuation of the screening drum (14) is one of interrupted and reversed to blowing air from the screening drum (14).

14. The intermediate card according to claim 13, characterized in that a run of the conveying belt (16) is subject to a vacuum at the transfer site (17) located between the screening drum (14) and the conveyor belt (16).

15. The intermediate card according to claim 11, characterized in that the conveyor belt is a permeable endlessly circulating conveyor belt (16) which loops about a rotating screening drum (14) defining the transfer sections **(15*a*, 15*b*, 15*c*, 15*d*) of the conveying surface (15), and the permeable conveying surface (15) is formed in common by the conveyor belt (16) and the screening drum (14) supporting the conveyor belt (16)**.

16. The intermediate card according to claim 11, characterized in that the conveyor belt (16) is pivoted about an axis coaxial to an axis of the screening drum (14) such that a site of transfer (20) of the nonwoven from the conveyor belt (16) is height-adjustable.

17. A method of manufacturing a nonwoven of fibrous material comprising the steps of feeding fibrous material by drawing-in of an intermediate card, combing the fibrous material on a main cylinder (4) of the immediate card, taking-off at least two card webs from the main cylinder (4), transferring the taken-off card webs onto vacuum transfer sections circumferentially offset with respect to each other which are part of a permeable conveying surface (15) curved in a circular cylindrical manner and having a circumferential speed adapted to the transfer speed of the card webs at the transfer sections **(15*a*, 15*b*, 15*c*, 15*d*), and directly transferring the card webs from the transfer sections (15*a*, 15*b*, 15*c*, 15*d*) to only one conveyor belt (16)**.

18. The method according to claim 17, characterized in that the conveying surface (15) is by a rotating screening drum (14) from which the taken-off card webs are transferred, and the conveyor belt (16) is permeable.

19. The method according to claim 18, characterized in that the permeable conveyor belt (16) loops about the rotating vacuum screening drum (14).

20. The method according claim 18 characterized in that each card web is taken off the main cylinder (4) directly by one of a doffer roller **(8*a*, 8*b*; 8*c*, 8*d*) and a tangling roller (3*c*, 3*d*) with a succeeding doffer roller (8*a*, 8*b*; 8*c*, 8*d*)**.

21. The method according to claim 18 characterized in that each card web is taken off the main cylinder (4) directly by one of a doffer roller **(8*a*, 8*b*; 8*c*, 8*d*) and a tangling roller (3*c*, 3*d*) in the absence of a succeeding doffer roller (8*a*, 8*b*; 8*c*, 8*d*)**.

22. The method according to claim 18, characterized in that each card web of a doffer roller (8*a*, 8*b*, 8*c*, 8*d*) is transferred onto the conveying surface (15) via a take-off roller (12*a*, 12*b*, 12*c*, 12*d*) with a stuffing roller (10*a*, 10*b*, 10*c*, 10*d*).

23. The method according to claim 18, characterized in that each card web of a doffer roller (8*a*, 8*b*, 8*c*, 8*d*) is transferred onto the conveying surface (15) via a take-off roller (12*a*, 12*b*, 12*c*, 12*d*) in the absence of a stuffing roller (10*a*, 10*b*, 10*c*, 10*d*).

24. The method according to claim 17 characterized in that each card web is taken off the main cylinder (4) directly by one of a doffer roller (8*a*, 8*b*; 8*c*, 8*d*) and a tangling roller (3*c*, 3*d*) with a succeeding doffer roller (8*a*, 8*b*; 8*c*, 8*d*).

25. The method according to claim 24, characterized in that each card web taken over from the main cylinder (4) by a tangling roller (3*c*, 3*d*) is shared between at least two doffer rollers (8*a*, 8*b*, 8*c*, 8*d*).

26. The method according to claim 17, characterized in that each card web of a doffer roller (8*a*, 8*b*, 8*c*, 8*d*) is transferred onto the conveying surface (15) via a take-off roller (12*a*, 12*b*, 12*c*, 12*d*) with or without a stuffing roller (10*a*, 10*b*, 10*c*, 10*d*).

* * * * *